United States Patent [19]

Oury

[11] 4,320,888

[45] Mar. 23, 1982

[54] CONCRETE FORM SYSTEMS AND COMPONENTS THEREOF

[76] Inventor: Ralph M. Oury, 123 Chase St., Wheaton, Ill. 60187

[21] Appl. No.: 50,187

[22] Filed: Jun. 20, 1979

[51] Int. Cl.[3] ..... E04G 17/12; E04G 17/02

[52] U.S. Cl. ..... 249/45; 249/46; 249/190; 249/191; 249/219 R

[58] Field of Search ..... 249/26, 42, 38, 40, 249/219 R, 189–192, 194, 195, 170, 25, 46, 44, 45, 213, 217, 219 W, 196

[56] References Cited

U.S. PATENT DOCUMENTS

| | | | |
|---|---|---|---|
| 1,221,567 | 4/1917 | Moncure | 249/192 |
| 1,702,671 | 2/1929 | Toogood | 249/191 |
| 2,190,748 | 2/1940 | Williams | 249/42 |
| 3,199,828 | 8/1965 | Newton | 249/191 |
| 3,327,986 | 6/1967 | Oury | 249/191 |

OTHER PUBLICATIONS

Kuhn-Oury, Sales Bul. (1975).
Anon. Concrete "Construction", Sep. 1974.
Kuhn-Oury Sales Bul. Rev. IV (1977).
Anon. Symons System of Wall Form Construction, Symons Clamp & Mfg. Co., Chicago (1950), p. 27.

*Primary Examiner*—Willard E. Hoag

[57] ABSTRACT

Concrete form systems and hardware components thereof wherein the inner and outer walls are composed of abutting, side-by-side plywood sheets and are tied together by wall ties and stud-bearing plates, wherein the improvements reside in: metal straps serving as inside and outside corner braces with right angled legs having specially spaced, transverse, tie-rod-receiving slots in one longitudinal edge of each leg; rectangular plates having a center hole and two studs projecting from its inner face on opposite sides of the hole, said plate having longitudinal, flange edges or lips forming the sides of a trough in the outer face; flat, metal straps for securing filler strips between plywood panels, which straps have specially spaced, transverse, tie-rod-receiving slots in one longitudinal edge; and hingedly connected, rectangular panels forming a right angle corner for the outside wall, said panels being foldable to a shipping and storing position in which the panels are in overlying, substantial face-to-face parallel relationship.

4 Claims, 14 Drawing Figures

CONCRETE FORM SYSTEMS AND COMPONENTS THEREOF

BACKGROUND

Many factors must be considered in developing an efficient form system for pouring concrete walls or the like. The system must be easy to assemble with proper alignment of the form walls. It must also be easy to disassemble after the concrete has been poured and has set. Furthermore, wastage of lumber and other parts used to make the concrete form system should be minimized to hold down costs for the contractor. It is especially desirable to have a concrete form system in which the panels constituting the walls of the form can be reused. Such panels constitute the bulk of material used in the concrete form system and they, accordingly, should be capable of being stacked in compact piles to minimize volume of storage space and size of trucks needed to transport the forms to and from the job. Additionally, a concrete form system utilizing reusable panels should be easily adaptable in the assembly of concrete form systems in the pouring of concrete walls of different thicknesses, and the varying of the length of individual walls of the poured concrete, and the like.

These and other desirable qualities for concrete form systems and component parts thereof are afforded by the invention herein described and claimed. Briefly, the invention relates to concrete form systems utilizing a pair of opposing walls into which the concrete can be poured. These walls are made up of a series of abutting, aligned panels adapted to receive hardware pieces which tie the opposing walls together in substantially rigid relationship and which also tie together in substantially rigid relationship adjacent abutting panels in a given wall. These panels contain, at spaced intervals along their abutting edges, holes adapted to receive studs of hardware pieces utilized to tie abutting panels together. The panels also contain apertures through which extend tie rods which connect the opposite walls together so that they are substantially rigid with respect to each other.

PRIOR ART

The subject invention concerns improvements in forms systems and hardware therefor of the type disclosed in my U.S. Pat. No. 3,327,986 issued June 27, 1967, and particularly the embodiments shown in FIGS. 7–14 thereof. Such form systems and hardware therefor are also described in *Concrete Construction* magazine, September, 1974 issue, in a Kuhn Oury sales brochure entitled *Much More Than Just Another Set of Forms,* published in 1975, and in a technical bulletin entitled *Technical Information on Kuhn/Oury Forming System,* published by Kuhn-Oury Concrete Forms, Inc., Carol Stream, Illinois on Jan. 1, 1977 with additions later in 1977. These prior art publications and the aforesaid patent describe the basic plywood sheet components and certain basic hardware components of the form systems of the subject invention.

OBJECTS

It is a basic object of this invention to provide improvements in concrete wall form systems and hardware therefor.

Another object is to provide improvements in corner brace structures used to brace intersecting plywood panels forming a right angle corner.

A further object is to provide improvements in the two-studded plates which are used, jointly with tie rods and ty-wedges, to interlock adjacent, side-by-side plywood panels and to tie together opposing parts of the inner and outer form walls.

Another object is to provide improvements in slotted, metal straps used to secure relatively narrow filler strips inserted between standard size panels of the form walls.

Yet another object is to provide improvements in corner forms having hingedly connected rectangular panels which swing 270° between a right angle-corner-forming position and a storing and shipping position wherein said panels are in parallel, overlying, substantially face-to-face position.

Another object is to provide improvements in the hinges used in the corner forms.

PREFERRED EMBODIMENTS

Preferred embodiments of the invention are illustrated in the accompanying drawings, wherein:

BRIEF SUMMARY OF THE INVENTION

The subject invention concerns improvements in the basic form systems described in the above prior art. More particularly, the invention is concerned with improvements in form systems for pouring concrete walls, in which systems the inner and outer walls of the form systems are composed mainly of abutting, side-by-side plywood sheets which are tied together wall to wall by tie rods and tied together panel to panel by stud-bearing plates, the studs of which are seated in predrilled holes through respective panels near the side edges thereof.

The plates are secured in the form system by a ty-wedge having a longitudinally slotted, inclined surface which is driven and wedged under a button on the projecting end of a tie rod. The latter projects through a third hole formed in the abutting edges of the panels by aligned, half-hole recesses and an aligned hole in the stud-bearing base plate. The base of the ty-wedge bears against the outer face of said plate.

The improvements reside in providing special, and different, spacings between three transverse slots extending from a longitudinal edge in each of the two right angled legs of a metal strap used as a corner brace for inside wall and outside wall, right angle corners; in providing longitudinal flanges or lips on opposite longitudinal edges of said plate to form a ty-wedge-guiding, longitudinal trough in the outer face of said plate; in providing flat, metal straps having special, and different, spacings between three transverse tie-rod-receiving slots on each side of the mid-point of said strap, and extending transversely from a longitudinal edge of the strap; in providing improvements in hingedly connected, rectangular panels adapted to form a right angle corner for the outside wall and swingable 270° to a folded, shipping and storing position in which said panels are in overlying, substantially parallel, face-to-face relationship; and in providing longitudinal flanges or lips, on opposite longitudinal edges of a corner plate having one stud and a plurality of aligned tie rod-receiving holes.

Figure 1:
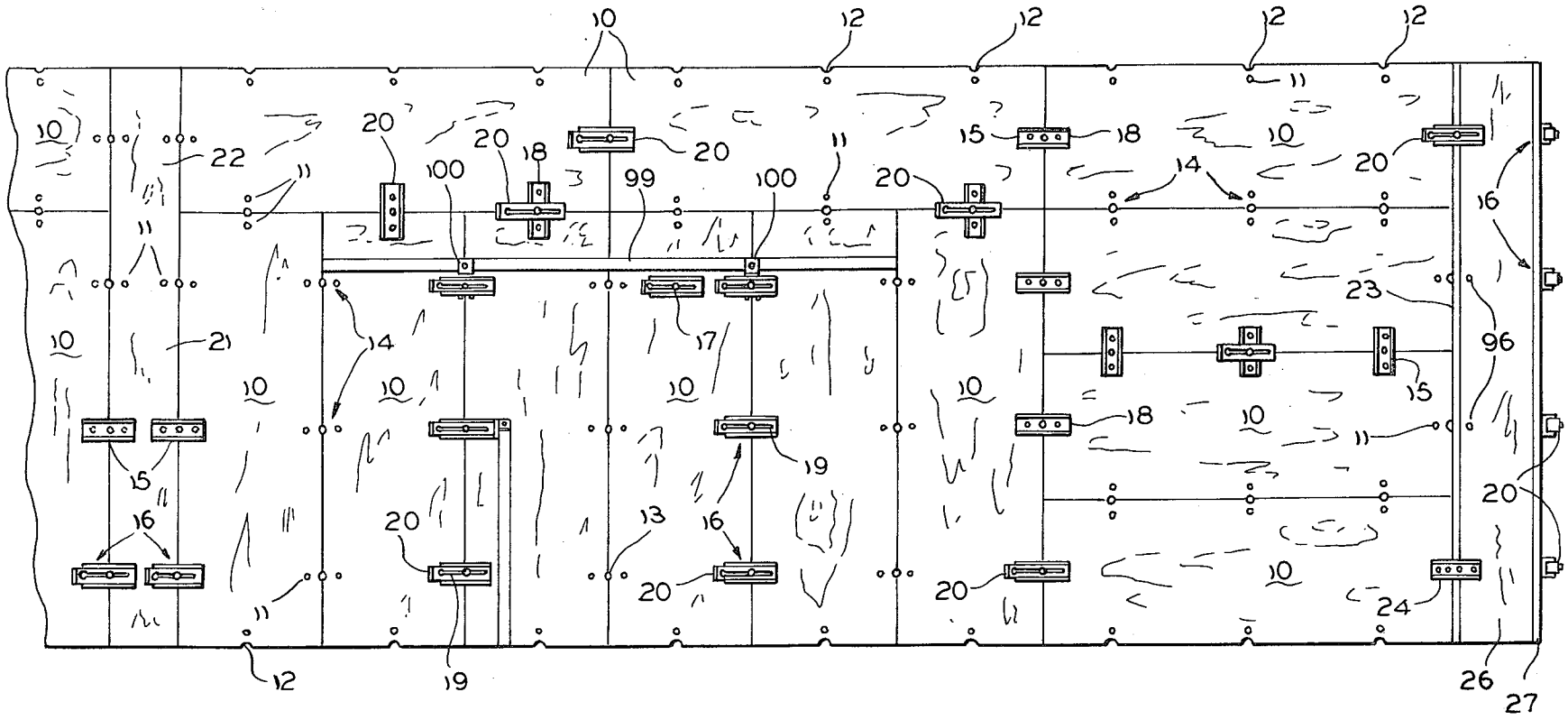
FIG. 1 is a fragmentary, side elevation of an outside wall, with part of the hardware mounted thereon, of a concrete form system of the invention.

Referring to FIG. 1, this figure does not represent a typical form wall but rather shows how the plywood panels 10 can be set vertically and horizontally with correct alignment of the stud-receiving holes, which are positioned about $1\frac{1}{2}''$ from the edge of the panels at intervals set forth in my aforesaid U.S. patent. The typical panels are $2' \times 8' \times 1\frac{1}{8}''$. The half holes 12 in each panel edge align opposite each other when the form panels are set properly and thus form tie-rod-receiving holes 13 at the junctures of abutting panels 10.

FIG. 1 in part shows the panels before any hardware is mounted thereon to illustrate the three hole groupings 14 formed by the two holes 11 and the center hole 13 formed by two half holes 12. FIG. 1 also in part shows some two-studded base plates 15 mounted on the form wall and also some of the final assemblies 16, each comprising the base plate 15 with the button 17 and its shank 39 of the wall tie rod (not shown in FIG. 1) projecting through the center hole 13 through the hole 18 in the plate 15 and through the slot 19 in the inclined surface of the ty-wedge 20.

Other parts of the form wall shown in FIG. 1 include spacer panels 21 and 22, each having along its four sides one or more holes 11 and half holes 12 which align with corresponding holes 11 and half holes 12 in the panels 10. The spacer panels of the types 21 and/or 22 are used to lengthen the form wall by a dimension less than the full width of the form panels 10. Typically, these spacer forms are manufactured in one inch width increments beginning with a 5" width and progressing ing at least up to 12" or even up to 1" less than the width of the panels 10.

Figure 9:
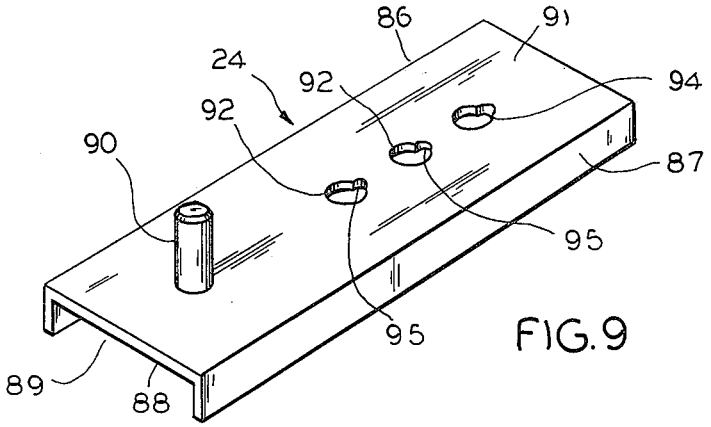
FIG. 9 is a perspective view of my improved stud-bearing plate having one fixed stud and three holes in which to grip the shank 39 of a wall tie rod, the plural number of holes being provided to accommodate various widths of filler strips next to the corner panel or assemblies without a filler strip.

Thus, spacer panels 21 and 22 fit into the form system in the same manner as the panels 10 and are held in the form wall by the same type of final assemblies 16. For spacer widths less than 5", a spacer strip 23 without holes 11 and half holes 12 is inserted between panels 10 and is held therein by a corner plate 24, the details of which are shown in FIG. 9, or by the flat strap illustrated in FIG. 6. The spacer strip 23 lies next to the right angle corner form 25, which is composed of two panels 26 and 27 at right angles to each other. The mounting of these corner plates by ty-wedges 20 is described later.

Figure 2:
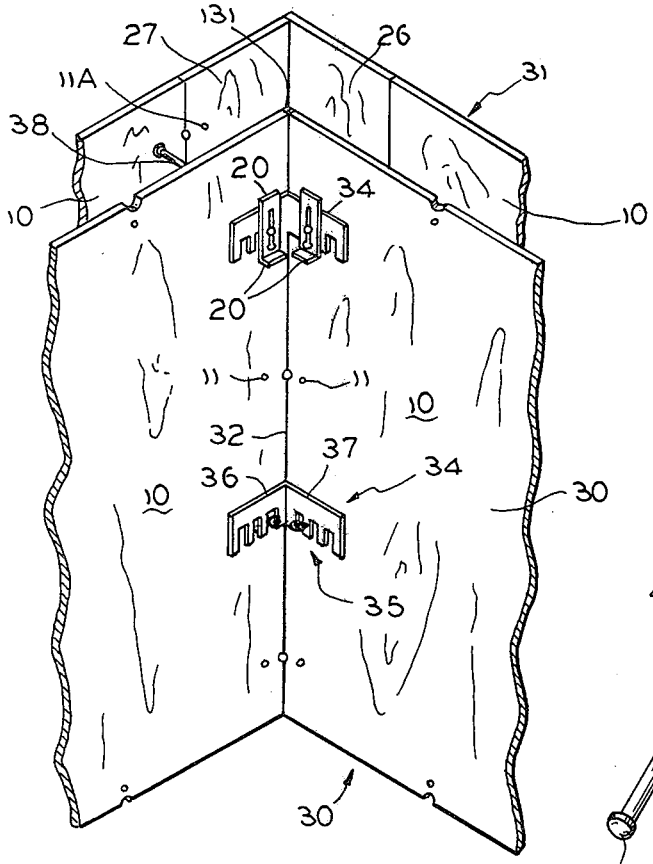
FIG. 2 is a fragmentary, perspective view of corner segments of the inside and outside form walls with part of the hardware mounted thereon.

FIG. 2 shows the corner segments of an inside form wall 30 and an outside form wall 31. The inside corner 32 is made by abutting the side edge of one panel 10 against the outer face 33 of the other panel along the side edge of the latter panel. The panels 10 are held in the right angle relationship by corner braces 34 having transverse slots 35 in one longitudinal edge of each of the right angled legs 36 and 37 of the corner brace 35. The slots 35 are dimensioned and spaced so that the projecting shank of the button 17 of wall tie rods 38 extending through the panel holes 11 in each panel will seat in one of the three slots 35 in each leg 36, 37 of the corner brace. Tie wedges 20 driven between the buttons 17 on the projecting ends of the tie rods and the respective legs 36, 37 of the corner brace fixedly secure together the two panels 10, the corner braces 11 and the projecting ends of the tie rods to provide a rigid inside corner.

The outside corner in FIG. 2 is like the corner 25 shown in FIG. 1. The panels 26 and 27 have the same width as the spacing between the inner faces of the inside and outside walls 30, 31.

Figure 3:
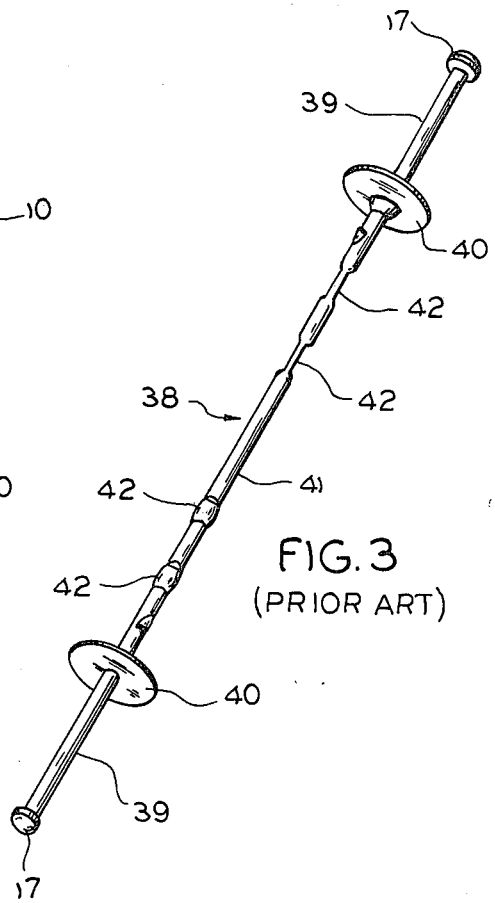
FIG. 3 (PRIOR ART)
FIG. 3 is a perspective view of a known, but preferred tie rod.

The known wall tie rod 38 is illustrated in FIG. 3. Besides the buttons 17 and the button shanks 39, the tie rods have two washers or discs 40 of diameters larger than the holes 13 in the abutting edges of contiguous panels. These discs or washers seat against the respective inner faces of the panels 10 about the holes 13. The distance therebetween determines the spacing between the inside and outside walls and hence determines the thickness of the poured concrete walls. The rod segment 41 betwen the washers or discs has narrow neck sections 42 which form zones of weakness. After the ty-wedges 20, and optionally also the form panels 10, are removed when the poured wall has set, the part of the tie rod projecting from each side of the wall is turned in order to break the tie rod at a weakened zone 42, now inside the poured wall.

Figure 4:
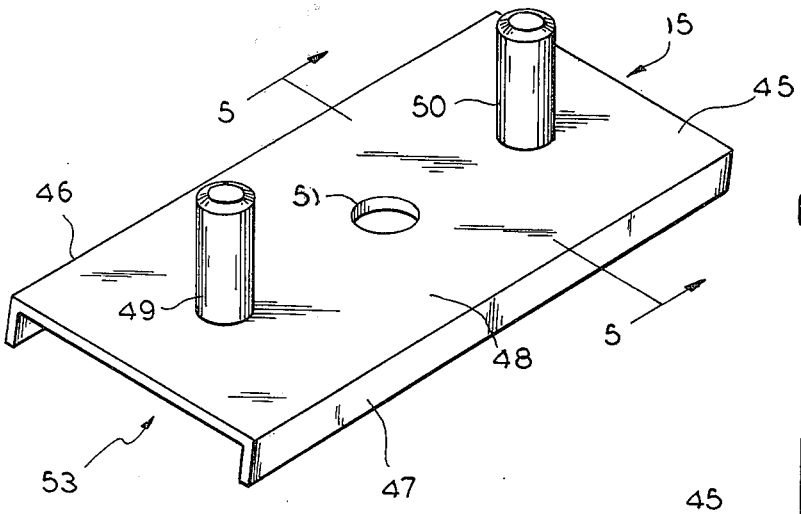
FIG. 4 is a perspective view of the stud-bearing plate aforedescribed.
Figure 5:
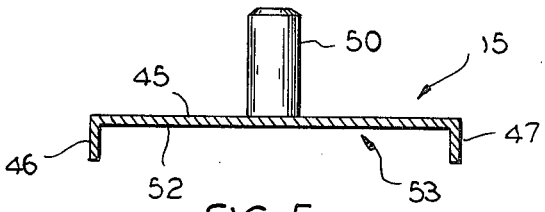
FIG. 5 is a section view taken on section plane 5—5 of FIG. 4.

FIGS. 4 and 5 illustrate the base plate improvement of the invention. The base plate 15 comprises a metal plate having one, preferably both, of its longitudinal edges bent in a direction away from the face 48 to form flanges or lips 46, 47. A pair of cylindrical studs 49, 50 project from, and at right angles to, the face 48. A center hole 51 through the base plate has a diameter sufficient to allow the button 17 of the tie rod to pass through the hole.

The flanges or lips 46, 47 preferably slope diagonally from the plane of the base plate but may be at 90° relative thereto. The flanges or lips provide two functions in strengthening the base plate against bending or twisting when it is under heavy load imposed by wet concrete poured between the form walls. First, the flanges or lips add strength against bending or twisting by virtue of their orientation out of plane with the main, planar portion of the plate. Second, the planar outer face 52 of said planar portion and the two longitudinal flanges or lips 46, 47 for a shallow trough 53 serving as a guide channel for insertion of a ty-wedge whose longitudinal axis coincides with the longitudinal axis of said plate 45 and its trough 53. When the ty-wedge is driven home between the button 17 of the tie rod and the face 52 of the base plate in this coinciding axis orientation, the ty-wedge supplements or adds to the strength of the base plate in resistance to bending or twisting of the latter. Referring back to FIG. 1, all but three of the illustrated tie wedges are shown in the aforesaid orientation. The three tie wedges positioned at right angles to the longitudinal axis of the base plates are so illustrated to show a different, though less preferred, mounting of the ty-wedges on the base plate.

The ty-wedge 20, a prior art article, comprises initially a metal plate which is stamped or otherwise formed into an arched, rear center segment 55 which draws the rearward sides 56, 57 inwardly. An inclined segment 58 slopes upwardly from the forward, bottom wall segment 59 substantially to the crest of the rear center segment. The inclined segment 58 has a longitudinal slot 60 which is wider than the tie rod shanks 39 but narrower than the diameter of the buttons 17. To wedge the ty-wedge 20 between the tie rod button 17 and the face 52 of the base plate 15, the button 17 is passed through the aperture 61 in the ty-wedge. With the axes of the ty-wedge and the trough 53 in alignment, the ty-wedge is pushed between the button and the planar face 52 of the base plate until the button wedges against the inclined segment 58. The ty-wedge is then driven home by striking the rear edge of the arched segment 62. A narrow, right angle lip 63 extends transversely across the leading edge of the ty-wedge to provide a surface for striking the ty-wedge to loosen it from its wedged position during removal of the ty-wedge.

Figure 6:
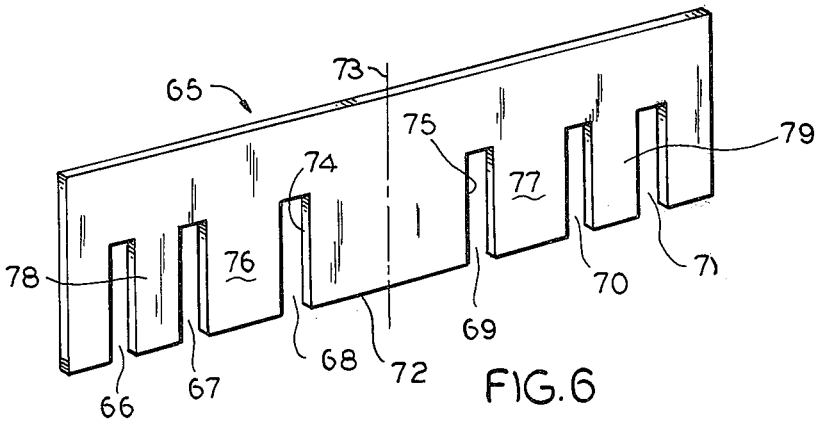
FIG. 6 is a perspective view of the flat strap with transverse slots as aforedescribed.

FIG. 6 shows another hardware piece, a flat metal strap 65 having six transverse slots 66, 67, 68, 69, 70, 71 extending transversely from and at right angles to the longitudinal edge 72. The slots have a width sufficient to receive the ends (shanks 39) of the wall tie rods 38. The strap 65 is used to span a narrow filler strip such as the strip 23 in FIG. 1 to hold the latter in place in the form wall. The strip is held in the form wall by wedging a ty-wedge 20 between the strap 65 and a button 17 on the projecting end 39, 17 of the tie rod 38 or a button on a dummy tie rod. The latter consists only of the disc or washer 40, the shank 39 and the button 17. It is used in the form system at places where a ty-wedge is needed but no tie rod projects through the form walls at such places. An example of such place is the pre-drilled hole 11A in FIG. 2.

In departure from known forms of these notched plates, where the three notches in each group of notches on opposite sides of the center line of the plate 65 were evenly spaced, the notches 66, 67, 68 and notches 69, 70, 71 are not evenly spaced. In the preferred form of the invention, the width of the slots is about $\frac{3}{8}''$. The holes 11 in the panels are spaced about $1\frac{1}{2}''$ inwardly from the edge of the panel. The distance between the center line 73 and the closest edges 74, 75 of notches 68, 69 is about $1\frac{1}{8}''$. The distance between contiguous edges of the innermost slots 68, 69 and the middle slots 67, 70, i.e., the width of the "teeth" 76, 77 is about 1" and the distance between contiguous edges of the middle slots 67, 70 and the outermost slots 68, 71, i.e., the width of the "teeth" 78, 79 is about $\frac{5}{8}''$. These positions and dimensions of the slots adapt the plate 65 to be used in spanning 1", 2", 3" or 4" filler strips and also facilitate use of these straps in joining together panels 10 with corner panels 26, 27 (FIG. 2).

Figure 7:
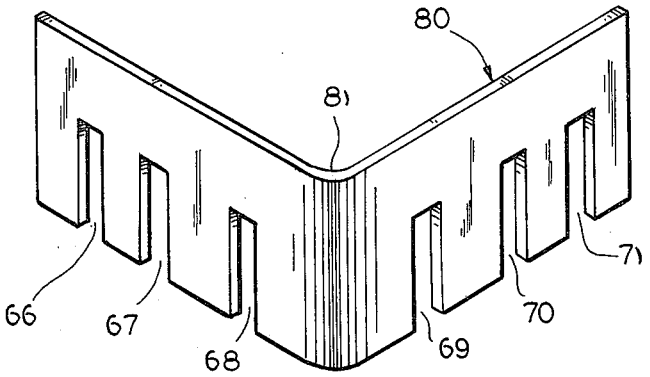
FIG. 7 is a perspective view of the corner brace with right angled legs and transverse slots in each leg, as aforedescribed.
Figure 8:
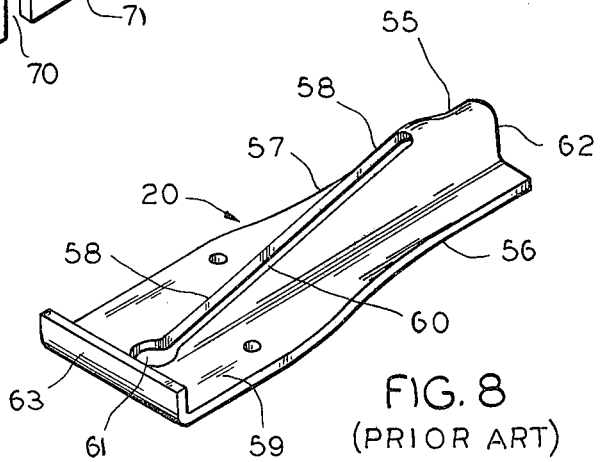
FIG. 8 (PRIOR ART)
FIG. 8 is a perspective view of my prior art ty-wedge.

The corner brace 80 in FIG. 7 is essentially the same as the flat strap 65 except that the corner brace has a 90° bend 81 at the center line 73, thereby yielding strap legs 82, 83 at right angles to each other. The width dimensions of the slots 66–71 and the spacings thereof relative to the 90° bend and to each other at the same as set forth above for the flat strap of FIG. 6—the 90° bend 81 of the brace corresponding to the center line 73 of the flat strap.

The corner plate 24 in FIG. 9 is similar in some respects to the base plate 15 of FIGS. 4 and 5 in that the plate 85 has its longitudinal edges bent into flanges or lips 86, 87 to form to form on the outer face 88 an longitudinal trough 89 having the same strength-imparting and ty-wedge guiding advantages described above for the base plate 15. The corner plate, however, has only one cylindrical stud 90 projecting from its inner face, and the plate has a plurality, e.g, three, axially aligned holes 92, 93, 94, each hole having a small recess 95 on the hole sides remote from the stud 90.

The outside corner panels 26, 27 (FIG. 1) have round holes 96 which are directly opposite the holes 11 and their respective half holes in the corner-panel-abutting panels 10 (in the illustrated case, the right-hand sides of the four horizontally laid outside wall panels next the filler strip 23).

Figure 14:
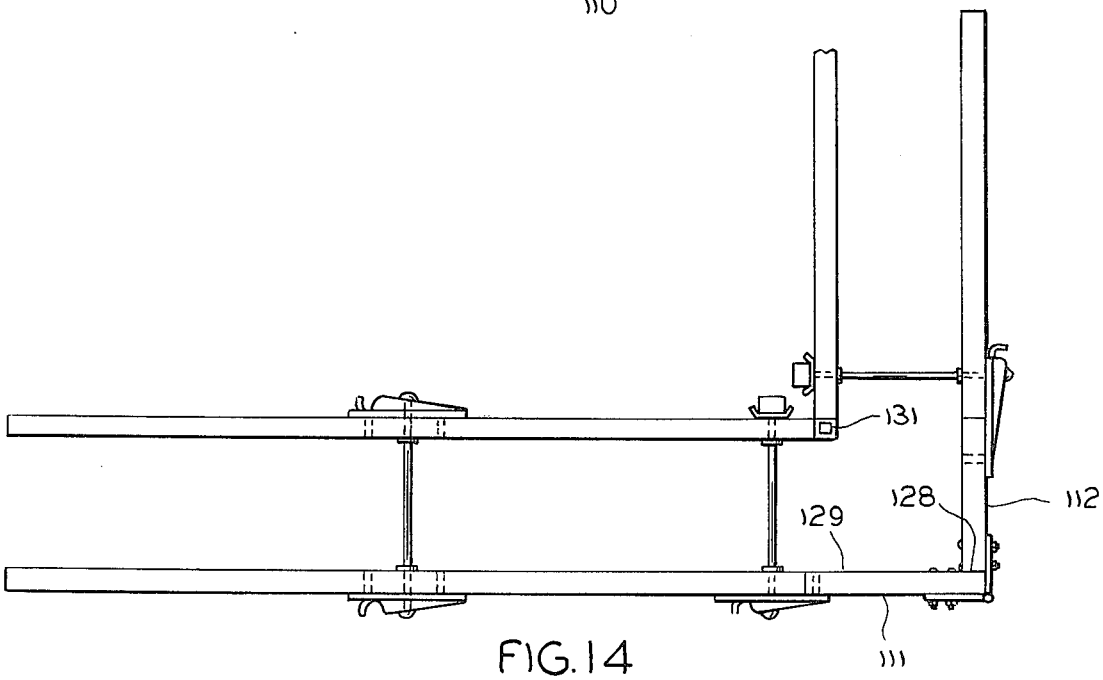
FIG. 14 is a top plan view of the parts illustrated in FIG. 13.

As can be seen in FIGS. 2 and 14, tie rods do not project through the corner panels 26, 27. Therefore, special measures are required to tie the corner panels 26, 27 to the contiguous wall panels 10. To do this, the button 17 of the tie rods projecting through the holes 11 which are closest to the corner panels is inserted through one of the holes 92–94 in the corner plate, and then the stud 90 is driven into a hole 96 in the corner panel. In so doing, the shank 39 of the tie rod is seated in the recess 95 of the particular hole 92–94. A ty-wedge can then be driven between the tie rod button 17 and corner plate 24—the ty-wedge preferably being seated coaxially in the trough 89 on the outer face of the corner plate.

Figure 10:
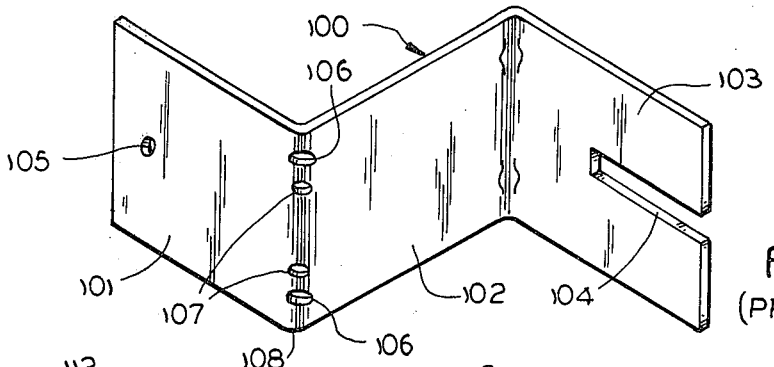
FIG. 10 (PRIOR ART)
FIG. 10 is a perspective view of my prior art hardware piece used to mount a waler barce or a walkway (a 2×4 or a 2×6) on the form walls.

FIG. 10 illustrates a bracket 100 used to mount 2×4 or 2×6 walers 99, longitudinally along the outer side of the form walls to strengthen them against bowing under load (FIG. 1) or to mount a 2×4 or 2×6 walkway along the wall. It is a metal strap having two 90° bends which form a vertical, outer or front leg 101, a horizontal mid-leg 102, and a vertical inner or rear leg 103. The latter has a vertical slot which slips over the shank 39 of a wall tie rod 38 behind the base plate 18, the waler or walkway being seated between the walls panels 10, the vertical leg 101 and the horizontal wall 102. Holes 105, 106 and 107 are provided in the leg 101 and at the 90° bend to allow nails to be driven into the 2×4 or 2×6.

FIGS. 11–14 illustrate forms systems utilizing a foldable outside corner form 110 and a special hinge construction which allows corner panels to swing 270° relative to each other between a corner-forming position and a folded, storing and shipping position.

The outside corner form 110 comprises two vertical, corner panels 111, 112 connected along a longitudinal edge of each of three hinges 113. Each hinge 113 comprises a first hinge strap 114 and a second hinge strap 115. The corner panels are mounted on the front faces 116 and 117 of the straps by the bolts 118, 119, 120, and 121. The hinge 122 is a typical door hinge having tubular segments from each hinge plate rotatably mounted on a hinge pin 123.

Figure 11:
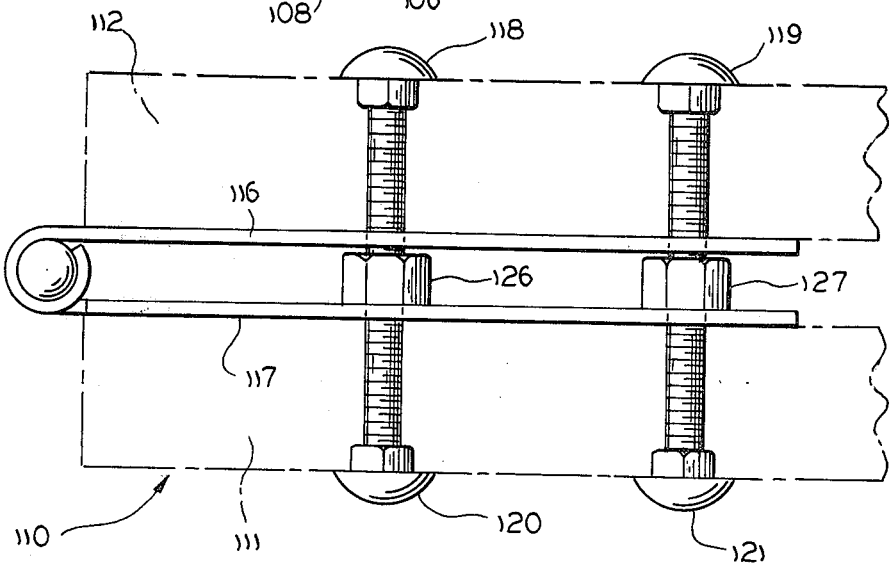
FIG. 11 is a top plan view of the hinge used in the foldable corner form with a fragment of each panel of the form shown in phantom.
Figure 12:
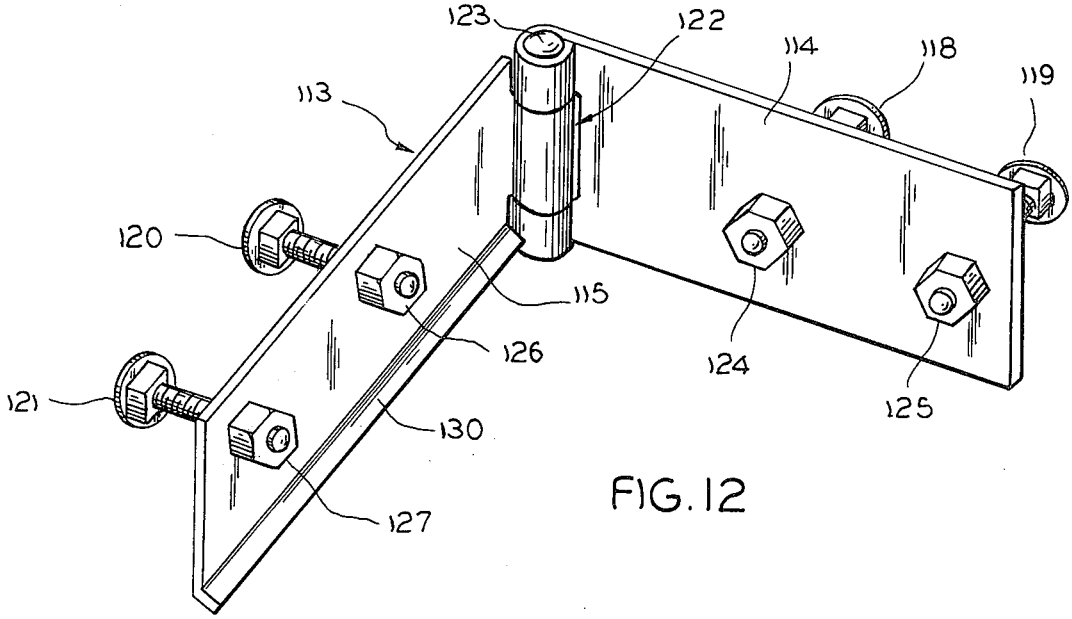
FIG. 12 is a perspective view of said hinge.

The shipping and storing position for the corner form is shown in FIG. 11. As can be seen best in FIG. 12 the bolts 118, 119 extend through the hinge strap 114 near the lower edge while the bolts 120 and 121 extend through the hinge strap 115 near the upper edge thereof. The respective pairs of bolts, therefore, are offset enough in the transverse direction so that the nuts 124 and 125 on hinge plate 114 do not strike the nuts 126 and 127 on the other hinge plate 115. The shipping and storing position thus is one in which the corner panels 111 and 112 are substantially parallel and overlie each other in substantial, but not actual, contact. The position of the threaded end of the bolts is preferably substantially flush with the nuts. (FIG. 11).

Figure 13:
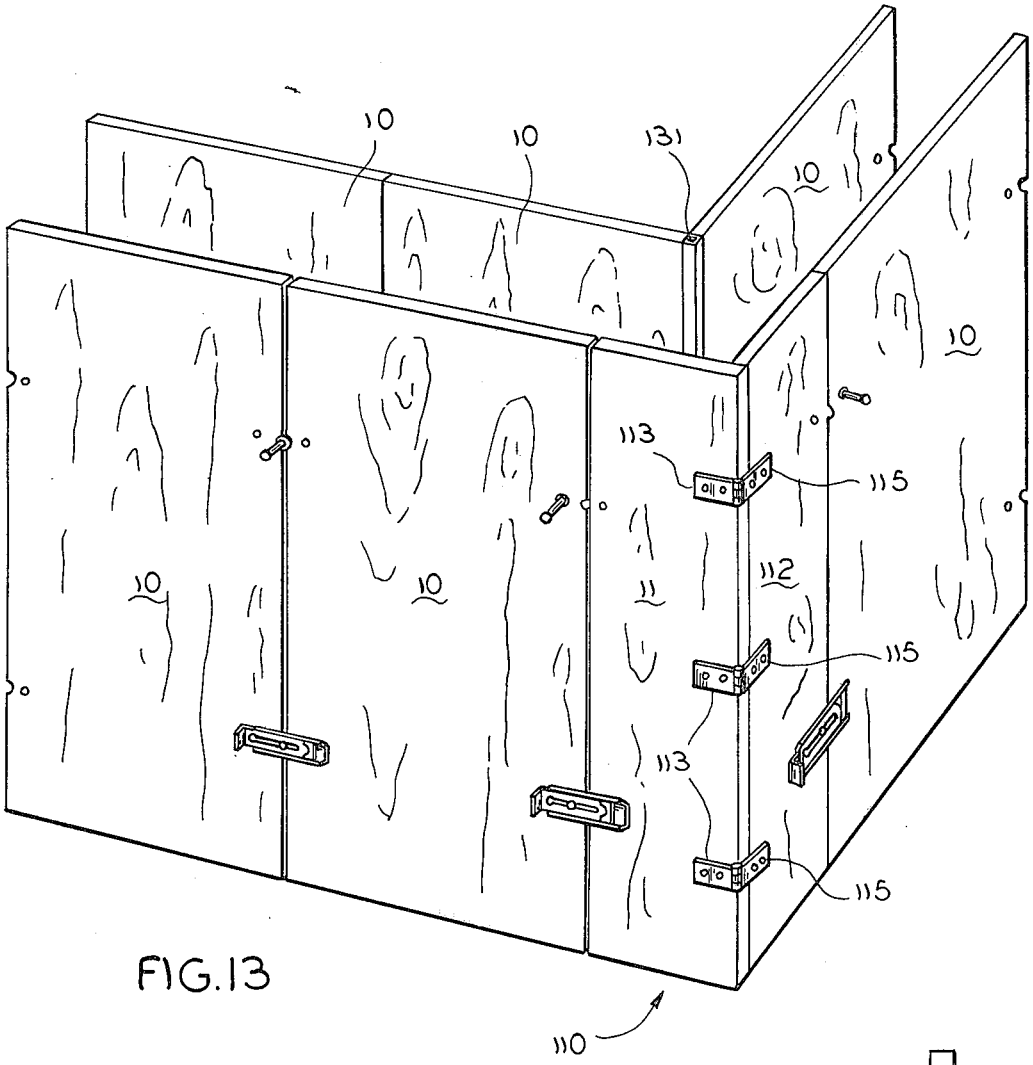
FIG. 13 is a perspective view of panels adjacent the corners of the inside and outside form walls with the aforesaid corner form mounted in the outside wall.

When the panels 111,112 are swung 270° to the right angle corner-forming position shown in FIGS. 13 and 14, they stop at the 90° relationship because the vertical side edge 128 of the panel 112 strikes the vertical edge of the face 129 of the corner panel 111. Because the hinge straps 115 of the three hinges 113 are subjected to greater stresses than are the hinge straps 114, the straps 115 preferably have one longitudinal edge bent to form a strengthening flange or lip 130.

The inside corner has a square, steel tube 131 which is used as filler to fill the right angle corner. The transverse dimension of the square tube 131 are the same as the thickness of the panels 10, e.g., $1\frac{1}{8}''$. The tube can be tacked to a vertical edge of one or both panels 10 by nails extending through nail holes (not shown) in the tube walls.

Returning to FIGS. 6 and 7, and the above-stated dimensions between notches 66–71, the flat strap 65 in FIG. 6 can be used to span filler strips of 1", 2", 3" and 4" width. For example, with a 1" filler strip inserted between the two panels 10 or a panel 10 and the outside corner panel 26 or 27, the distance between full holes 11 of said two panels 10 or full hole 11 of panel 10 and full hole 96 in the outside corner panel 10 (a dummy tie is inserted in hole 96) is 4" ($1\frac{1}{2}+1+1\frac{1}{2}$). Here, notches 68 and 70 or 67 and 69 provide the 4" span. For a 2" filler strip, notches 67 and 70 are used. For a 3" filler strip, notches 67 and 71 or 66 and 70 are used. For a 4" filler, notches 66 and 71 are used.

For inside corners of the type shown in FIGS. 13 and 14, e.g., with a corner filler tube 131, the notches 68 and 69 of the inside corner strap 80 are used. With a plywood filler strip (not shown) adding 1" to an inside wall length and used in lieu of filler tube 131, notches 68 and 70 or 67 and 69 are used. With a plywood right angle corner piece (not shown) adding 1" to the length of each inside wall, notches 67 and 70 are used. Notches 66 and 71 are used when adding 2" to the respective inside walls.

I claim:

1. A rectangular plate adapted to tie together side-by-side, edge abutting panels used as wall members in a concrete form system, said plate having a center hole and two studs projecting from the inner face thereof on opposite sides of said hole and at substantially equal distances from said hole, said hole and the opposite, longitudinal edges of said plate being bent less than 90° in the direction away from said inner face to provide longitudinal, transverseley diagonal flange edges on opposite longitudinal sides of said plate.

2. A rectangular plate as claimed in claim 1, wherein said longitudinal flange edges and the outer face of said plate between said flange edges form a trough with a flat bottom and diagonally sloping side edges, thereby providing a guide channel for inserting a ty-wedge between said plate and a button on the end of a tie projecting through said hole.

3. In a concrete form system comprising a series of abutting panels forming a pair of spaced, opposing walls, each panel having at least one hole adjacent its abutting edges, plates having a pair of studs rigidly mounted thereon and projecting from the front face thereof, said plates being oppositely positioned on said walls across the abutting edges of said panels with the studs on said plates seated in said holes in contiguous abutting panels, said plates having an aperture therein, tie rods connecting said opposing walls and extending therethrough with the ends of said tie rods extending through said apertures in said plates, the improvements wherein the opposite, longitudinal edges of said plate are bent less than 90° to form longitudinal flanges, whereby the rear face of said plate and said flanges form a trough serving as a guide channel, a button on each end of said tie rods, a ty-wedge having its base slidably seated in said trough and extending longitudinally in said trough, and said ty-wedge having a longitudinally slotted, inclined surface tightly wedged between one of said buttons on a tie rod and said plate with the tie extending through said slot and the longitudinal axis of said base and the longitudinal axis of said trough being substantially parallel.

4. A concrete form system as claimed in claim 3, wherein one end of said base of said ty-wedge has a small lip projecting at right angles to the plane of said base.

* * * * *